US005328187A

United States Patent [19]

De Marchi

[11] Patent Number: 5,328,187

[45] Date of Patent: Jul. 12, 1994

[54] CHESS GAME APPARATUS

[76] Inventor: Laura S. De Marchi, Pedernera 1407, San Luis, Argentina, 5700

[21] Appl. No.: 27,649

[22] Filed: Mar. 8, 1993

[51] Int. Cl.[5] ..... A63F 3/02

[52] U.S. Cl. ..... 273/237; 273/239; 273/260; 273/283

[58] Field of Search ..... 273/237, 239, 260, 261, 273/241, 283; D21/23, 24, 34

[56] References Cited

U.S. PATENT DOCUMENTS

| | | | |
|---|---|---|---|
| 2,665,913 | 1/1954 | Hlavac | 273/239 |
| 3,610,626 | 10/1971 | Nolte | 273/261 |
| 3,802,708 | 4/1974 | Libert | 273/237 |
| 3,893,671 | 7/1975 | Gardner | 273/238 |
| 3,977,682 | 8/1976 | Aida | 273/237 |
| 4,696,476 | 9/1987 | Eplett | 273/241 |

*Primary Examiner*—Benjamin H. Layno
*Attorney, Agent, or Firm*—Leon Gilden

[57] ABSTRACT

A plurality of individual chess boards are arranged in adjacency relative to one another, with the chess board having a first end spaced from a second end, with each chess board associated with each player, and each chess board including an individual set of chess game tokens that are operative to effect combat per conventional chess rules relative to the other game boards by permitting movement from a first end of one of the boards to a further first end of a further of the boards, and each second end of one of the boards is arranged for movement of tokens therefrom to a second end of the further boards.

1 Claim, 4 Drawing Sheets

Fig. 1
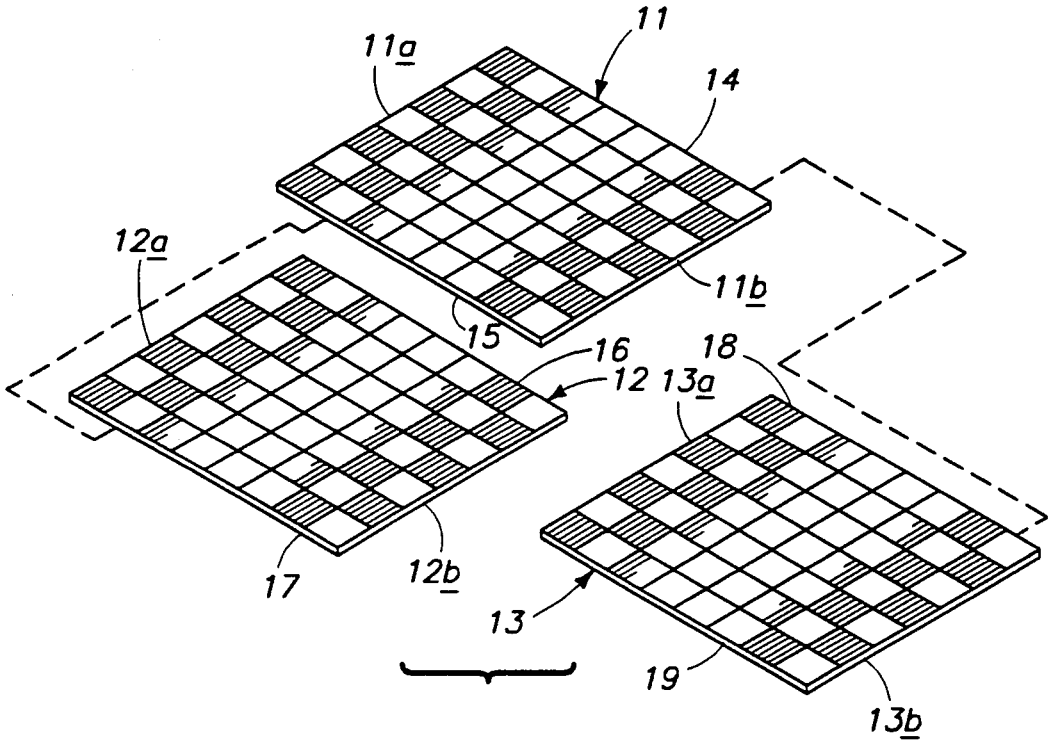
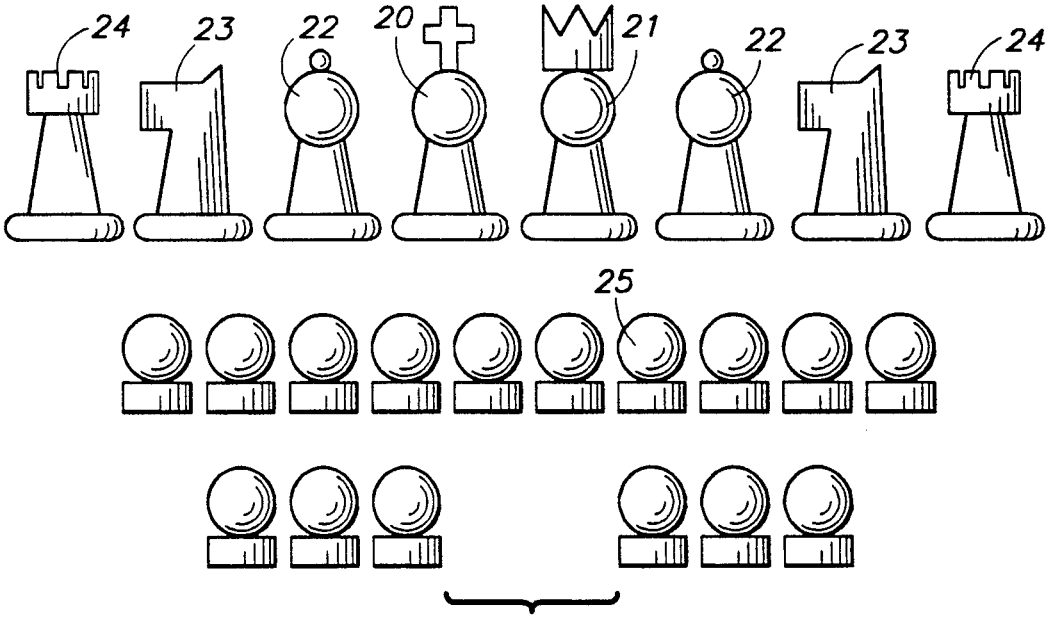
Fig. 2

Fig. 3
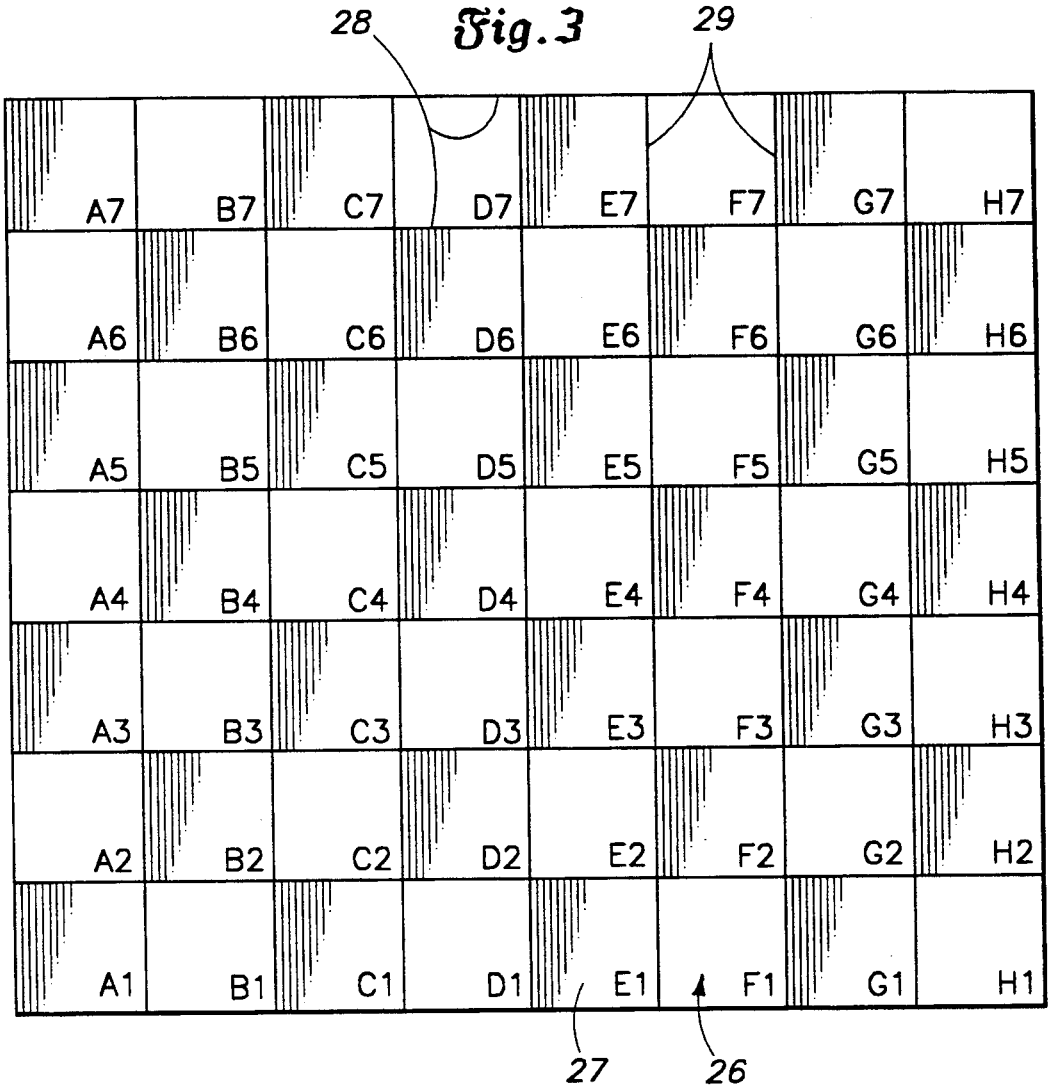
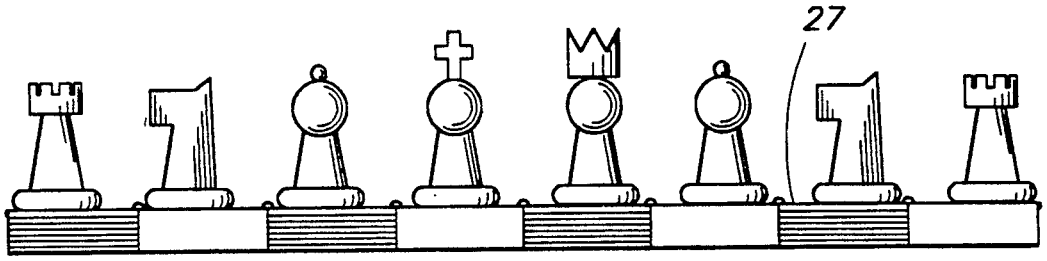
Fig. 4

CHESS GAME APPARATUS

BACKGROUND OF THE INVENTION

1. Field of the Invention

The field of invention relates to chess game apparatus, and more particularly pertains to a new and improved chess game apparatus wherein the same is arranged for movement among a plurality of boards of various sets of tokens.

2. Description of the Prior Art

Chess game structure of various types have been utilized in the prior art and indicated in U.S. Pat. Nos. 4,211,420; 4,778,187; 4,653,759; and 4,940,241.

The instant invention attempts to overcome deficiencies of the prior art wherein the prior art has heretofore utilized integral board structure, wherein the instant invention permits repositioning of game boards relative to other game boards to permit play among a plurality of players and in this respect, the present invention substantially fulfills this need.

SUMMARY OF THE INVENTION

In view of the foregoing disadvantages inherent in the known types of chess game apparatus now present in the prior art, the present invention provides a chess game apparatus wherein the same utilizes a plurality of game boards permitting interplay among the various game boards by a like number of players. As such, the general purpose of the present invention, which will be described subsequently in greater detail, is to provide a new and improved chess game apparatus which has all the advantages of the prior art chess game apparatus and none of the disadvantages.

To attain this, the present invention provides a plurality of individual chess boards arranged in adjacency relative to one another, with the chess board having a first end spaced from a second end, with each chess board associated with each player, and each chess board including an individual set of chess game tokens that are operative to effect combat per conventional chess rules relative to the other game boards by permitting movement from a first end of one of the boards to a further first end of a further of the boards, and each second end of one of the boards is arranged for movement of tokens therefrom to a second end of the further boards.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved chess game apparatus which has all the advantages of the prior art chess game apparatus and none of the disadvantages.

It is another object of the present invention to provide a new and improved chess game apparatus which may be easily and efficiently manufactured and marketed.

It is a further object of the present invention to provide a new and improved chess game apparatus which is of a durable and reliable construction.

An even further object of the present invention is to provide a new and improved chess game apparatus which is susceptible of a low cost of manufacture with regard to both materials and labor, and which accordingly is then susceptible of low prices of sale to the consuming public, thereby making such chess game apparatus economically available to the buying public.

Still yet another object of the present invention is to provide a new and improved chess game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the game boards of the invention.

FIG. 2 is an orthographic view of typical chess token set for each game board.

FIG. 3 is an orthographic top enlarged view of each chess board.

FIG. 4 is an orthographic side view of the tokens positioned upon the chess boards.

DESCRIPTION OF THE PREFERRED EMBODIMENT

Figure 5:
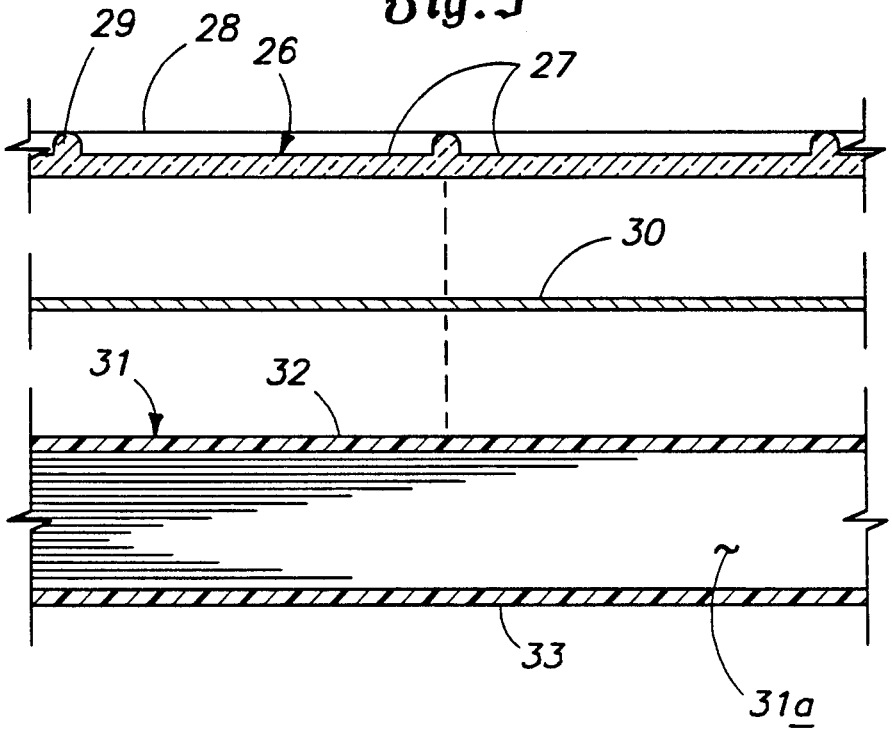
FIG. 5 is a modified chess board structure of each of the chess boards.
Figure 6:
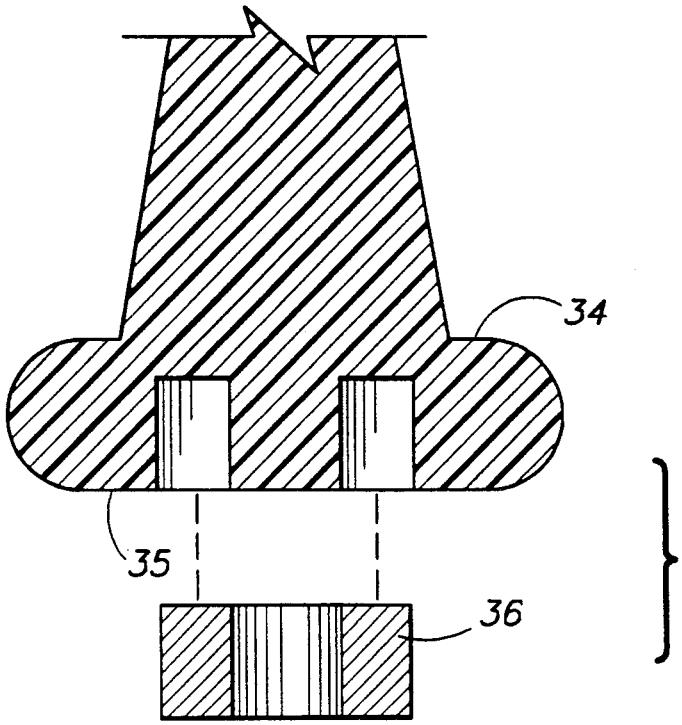
FIG. 6 is an enlarged orthographic cross-sectional illustration of each player token base portion.

With reference now to the drawings, and in particular to FIGS. 1 to 9 thereof, a new and improved chess game apparatus embodying the principles and concepts of the present invention and generally designated by the reference numerals 11–46 will be described.

More specifically, the chess game apparatus of the instant invention essentially comprises a first, second, and third chess board 11, 12, and 13. Each chess board includes a first side spaced from a second side, such as the first chess board 11 having a first side 11*a* and a second side 11*b*, with the second chess board 12*a* spaced from the second chess board 12*b*, the third chess board having a third chess board first side 13*a* and a third chess board second side 13*b*. The first chess board includes a first chess board first end 14 spaced from a second end 15, the second chess board having a second board first end 16 spaced from a second board second end 17, the third board having a third board first end 18 spaced from a third board second end 19. Each chess board, and accordingly each player having an individual chess board is awarded a complement or array of tokens, such as indicated in FIG. 2, to include a king token 20, a queen token 21, two bishop tokens 22, two knight tokens 23, two castle tokens 24, and sixteen pawn tokens 25. The king, queen, bishop, castle, and knight tokens are arrayed medially of the chess board extending from the first side to the second side of each chess board relative to each individual player. Accordingly, each party of tokens for each player is afforded a contrasting coloration. The pawn tokens are arrayed in a single row above and below the medial row containing the king, queen, bishop, knight, and castle tokens. Inasmuch as seven rows and eight columns are afforded each player board, the pawn tokens are positioned in the third and fifth rows, while the remaining tokens are positioned in the fourth row. Movement of play of the tokens is controlled by conventional chess rules regarding to movement of the player tokens and capture of the king, etc. relative to intervals of chess. In play of the game, the tokens are directed to move from a first end of one board to an associated second end of another board, as desired, and movement from a second end of any of the boards 11 through 13 to a further second end of any of the other boards to effect interplay among the players. Of the three players, the first player to capture an opponent's king is awarded a predetermined point total such as three, the player who comes in second depending upon the remaining players availed to that player, is awarded two points, and the player with the least amount of player tokens is awarded a single point. The game may be repeated as desired and a player with the greatest number of points is declared a winner.

The FIG. 3 indicates that the rows are indicated by the rows 1–7 and the columns indicated by the letters "A" through "H" of each game board, with parallel ribs directed on opposed sides of each row of spaces and orthogonally intersecting parallel columns of the ribs 29, wherein the intersecting rows and columns of ribs 28 and 29 define board spaces 27.

Figure 7:
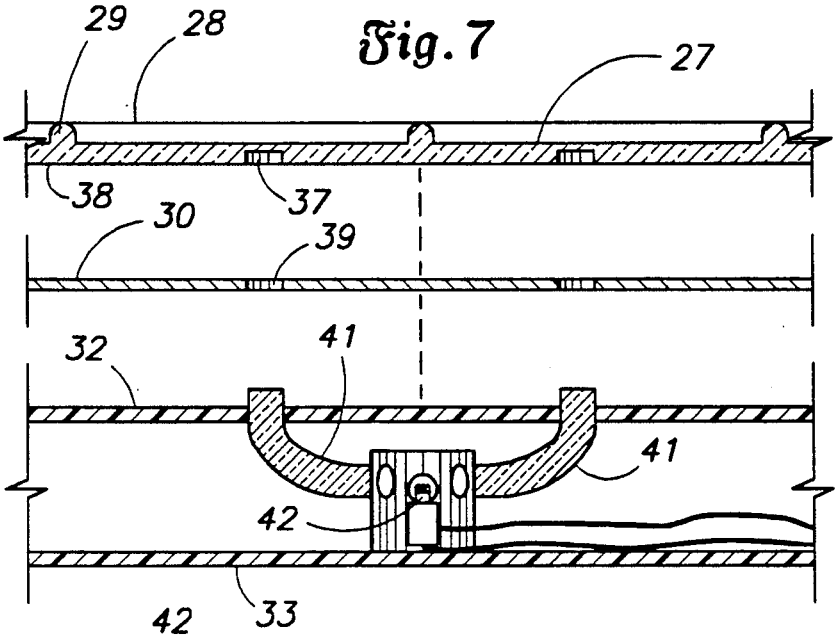
FIG. 7 is an orthographic enlarged illustration of the modified chess board structure having illumination means therewithin.
Figure 8:
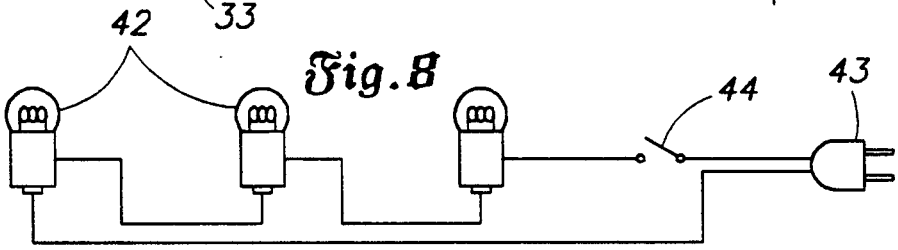
FIG. 8 is a diagrammatic electrical illustration of the illumination structure of the chess board housing, as indicated in FIG. 7.

The FIG. 5 indicates a modified game board structure arranged for each game board of the game boards 11, 12, and 13, having a board transparent top wall 26, with an underlying ferrous metallic web 30 coextensive therewith, with the web positioned to a housing top wall 32 of a housing 31. The housing top wall 32 is spaced from a housing bottom wall 33, having a housing cavity 31*a* therebetween the top and bottom walls. The FIG. 6 indicates the use of each of the tokens 20–25 of each of the players having a token base 34, including a base bottom wall 35. Within each base bottom wall 35 is a ferromagnet 36 arranged for adherence to the game board and attraction to the ferrous metallic web 30 positioned below the transparent board top wall 26. The housing cavity 31*a*, as indicated in FIG. 7, is arranged to include a plurality of illumination housings 40, as indicated by way of example in FIG. 7. Each of the housings 40 includes a plurality of fiber optic cables 41, with a single fiber optic cable 40 arranged for reception within a transparent top wall recess 37 directed into the transparent top wall 26 to a bottom surface 38 thereof. Each fiber optic cable is arranged for reception through an associated metallic web bore 39 that is arranged in alignment with a respective top wall recess 37. Each of the fiber optic cables are fixedly mounted through the housing top wall 32, with each first end of each fiber optic cable arranged for adjacency to illumination bulb 42 within each associated illumination housing 40. An electrical supply line 43 directs electrical current to each illumination bulb 42 through a switch 44. In this manner, positioning of the tokens relative to an associated fiber optic cable first end of each fiber optic cable 41 is afforded. The number of illumination housings 40 positioned within the housing cavity 31*a* is optional but sufficient to insure that a fiber optic cable 41 is directed into an orientation medially of each of the spaces 27 within an associated recess 37. In this manner, limited available light in play provides for ease of positioning of an associated token relative to a respective space 27.

Figure 9:
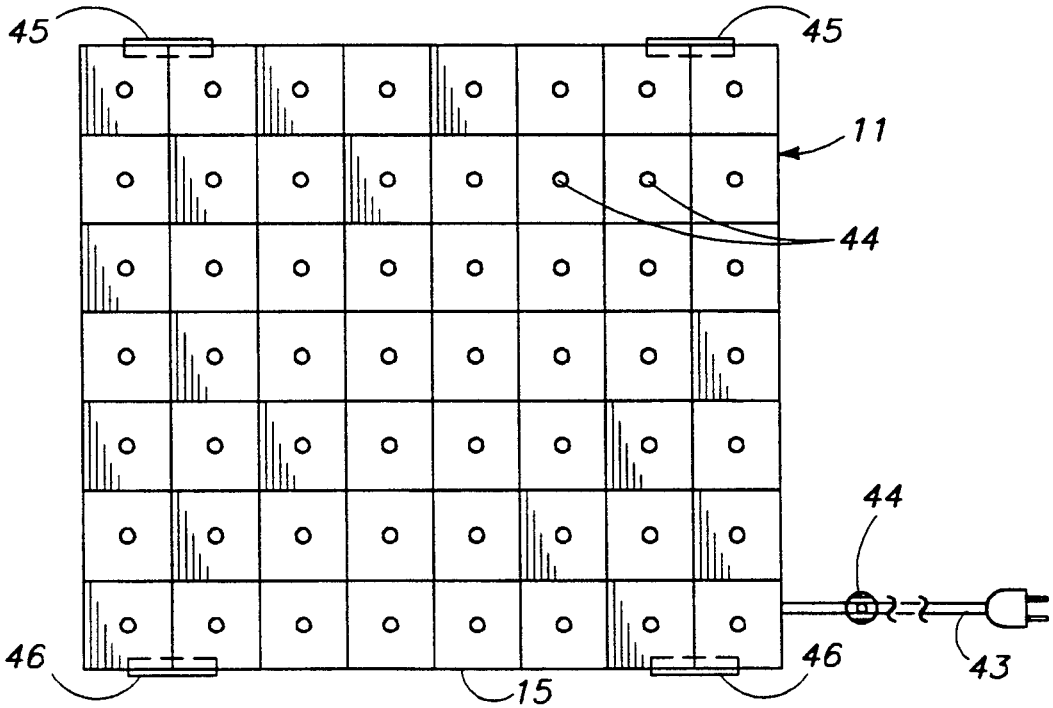
FIG. 9 is an orthographic top view of a modified chess board structure as employed in FIG. 7.

The FIG. 9 indicates that each game board of the game boards 11, 12, and 13 includes a plurality of first end magnets 45 spaced from a plurality of second end magnets 46. The first end magnets 45 are of a first polarity, and the second end magnets 46 are of a second polarity to permit the selective positioning selectively of the game boards relative to one another of a first end of one game board mounted to a second end of the further of the other game boards. In this manner, the game boards may be switched during play of the game to afford a further enhancement in use of the game, wherein the game may be stored more readily and arranged for securement relative to one another during play of the game, with securement of the first and second magnets of respective game boards relative to one another.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A chess game apparatus, comprising, a first chess board, a second chess board, and a third chess board, wherein the first chess board is arranged in a spaced relationship relative to the second chess board and to the third chess board, with the second chess board spaced from the first chess board and the third chess board, wherein the first chess board includes a first board first end spaced from a first board second end, the second chess board having a second board first end and second board second end, the third chess board having a third board first end spaced from a third board second end, with a predetermined number of parallel rows extending from each first end to each second end of each respective chess board, and each of the rows having a predetermined number of spaces, and the first chess board having first game tokens of a first coloration, the second chess board having second tokens of a second coloration, the third board having third tokens of a third coloration, wherein the tokens are arranged for movement among the first chess board, the second chess board, and the third chess board for movement from one of the first ends to a further one of the first ends of an adjacent game board of said first, second, and third game boards, and the tokens arranged for movement from each second end of said first board second end, said second board second end, and said third board second end to a further second end of an adjacent game board of said first, second, and third game boards, and each token includes a token base, each token base having a base bottom wall, and each base bottom wall including a ferromagnet member mounted therewithin, and each chess board of said first, second, and third chess boards including a transparent top wall, a ferrous metallic web positioned below each transparent bottom wall, and a housing positioned below the ferrous web, with the tokens arranged for magnetic adherence to each ferrous web of each game board, and each game board first end includes first magnets of a first polarity, and each game board second end includes second magnets of a second polarity to permit magnetic adherence of the first, second, and third game boards together in a random pattern, and each game board housing includes a plurality of illumination housings, each illumination housing includes a plurality of fiber optic cables extending from the game board housing through the ferrous web, and each transparent top wall including a top wall recess directed into each transparent top wall to receive one of the fiber optic cables therein, and each fiber optic cable to indicate individual spaces of each game board.

* * * * *